US008622234B2

(12) United States Patent
Koide et al.

(10) Patent No.: US 8,622,234 B2
(45) Date of Patent: Jan. 7, 2014

(54) PACKAGING METHOD AND PACKAGING CONTAINER

(75) Inventors: Satoshi Koide, Okazaki (JP); Shotaro Itami, Toyota (JP); Soh Hatakeyama, Nisshin (JP); Hidekazu Kanbara, Aioi (JP); Shigeki Teruoka, Tatsuno (JP)

(73) Assignees: Toyota Jidosha Kabushiki Kaisha, Toyota-Shi (JP); Showa Denko Kabushiki Kaisha, Minato-Ku (JP)

( * ) Notice: Subject to any disclaimer, the term of this patent is extended or adjusted under 35 U.S.C. 154(b) by 1107 days.

(21) Appl. No.: 12/305,185

(22) PCT Filed: Feb. 25, 2008

(86) PCT No.: PCT/JP2008/053717

§ 371 (c)(1),
(2), (4) Date: Dec. 16, 2008

(87) PCT Pub. No.: WO2008/108318

PCT Pub. Date: Sep. 12, 2008

(65) Prior Publication Data

US 2009/0277911 A1 Nov. 12, 2009

(30) Foreign Application Priority Data

Mar. 1, 2007 (JP) ..... 2007-051890

(51) Int. Cl.
*B65D 25/16* (2006.01)

(52) U.S. Cl.
USPC ..... 220/495.08; 220/495.01; 220/1.6

(58) Field of Classification Search
USPC ..... 220/1.6, 62.21, 495.01, 495.08, 495.11
See application file for complete search history.

(56) References Cited

U.S. PATENT DOCUMENTS

| | | | | |
|---|---|---|---|---|
| 3,051,367 | A * | 8/1962 | Einhorn | 229/117.28 |
| 3,836,037 | A * | 9/1974 | Bass | 220/264 |
| 5,419,452 | A * | 5/1995 | Mueller et al. | 220/495.08 |
| 6,585,153 | B2 * | 7/2003 | Ryan | 229/117.32 |

FOREIGN PATENT DOCUMENTS

| | | | |
|---|---|---|---|
| JP | 2002-225937 | A | 8/2002 |
| JP | 2005-298050 | A | 10/2005 |
| WO | WO 2007/139978 | A2 | 12/2007 |

* cited by examiner

*Primary Examiner* — Anthony Stashick
*Assistant Examiner* — Christopher McKinley
(74) *Attorney, Agent, or Firm* — Kenyon & Kenyon LLP

(57) ABSTRACT

A packaging container comprises an openable outer case and a bag for packaging a resin material in the outer case. The bag is partially turned back at fold portions so that part of the bag is turned inside out, and at least part of the out-turned part is fixed as a fixing part to any part other than the bag. The inner surfaces of the bag at the fold portions are placed in contact with each other, forming a contact portion, to seal the resin material. The contact portion is placed in correspondence with an openable part of an opening flap of the outer case.

10 Claims, 9 Drawing Sheets

PACKAGING METHOD AND PACKAGING CONTAINER

This is a 371 national phase application of PCT/JP2008/053717 filed 25 Feb. 2008, claiming priority to Japanese Patent Application No. 2007-051890 filed 1 Mar. 2007, the contents of which are incorporated herein by reference.

TECHNICAL FIELD

The present invention relates to a packaging method using a packaging container including an outer case such as a cardboard box internally provided with a bag for containing contents such as resin material, and also relates to the packaging container.

BACKGROUND ART

Heretofore, for example, a material 100 is carried in a plant or factory in such a manner that the material 100 is packed in a bag 101 and contained in a cardboard box 102 which is an outer case as shown in FIG. 12.

The cardboard box 102 is formed at its bottom with two pairs of gatefold flaps 103. The flaps 103 are closed with a sealing adhesive tape or the like. The bag 101 is formed at its bottom with an opening 104. The bag 101 is therefore folded to close the opening 104 and set in the cardboard box 102. The bag 101 is provided with a holding part 105 at the top.

The contents packed in such a packaging container are usually taken out by manual works. Specifically, the cardboard box 102 is turned upside down, the adhesive tape is removed from the flaps 103, the opening 104 is opened, and a worker takes out the content.

However, in the case where the material 100 contained in the cardboard box 102 is carried in the plant or factory, it is inefficient to manually take out the materials 100 from the packaging containers one by one.

It is therefore conceivable that the worker opens the flaps 103 of the cardboard box 102 as shown in FIG. 13 while grasping the holding part 105 to have the material 100 fall by its own weight. If the material 100 has a certain weight and the opening 104 is not sealed with adhesive tape or the like, the material 100 can push open the opening 104 and fall out of the bag 101.

JP2002-225937A discloses a container including a container body 106 and a bag 107 joined to an edge of an open end of the container 106, in which margarine 108 is filled, as shown in FIG. 14. The bag 107 has an open one end opening in the same position as the open end of the container body 106.

To release the margarine 108, the container body 106 is turned upside down to bring the open end downward, and air holes formed in the bottom of the container body 106 are opened as shown in FIG. 14. Thus, air enters the container body 106 through the air holes, peeling the bag 107 and allowing the margarine 108 to fall by its own weight as shown in FIG. 15.

DISCLOSURE OF INVENTION

Problems to be Solved by the Invention

However, the conventional packaging containers and methods have the following disadvantages.

(1) In the packaging container shown in FIG. 12, if the material 100 has high stickiness, an upward adhesive force A will occur between the bag 101 and the material 100 as shown in FIG. 13.

If the adhesive force A is equal to or larger than the self weight B of the material 100 acting downward, the material 100 may not be separated from the bag 101 nor fall down. If the adhesive force A is smaller than but nearly equal to the self weight B, it takes long for the material 100 to be separated from the bag 101, needing much time to fall down.

(2) The packaging container of JP '937 allows even the margarine 108 having high stickiness to be easily separated or separated from the bag 107. However, the edge of the bag 107 is joined to the open end of the container body 106 and thus the bag 107 could not cover over the margarine 108. Thus, a lid is required for sealing the container.

The present invention has been made in view of the above circumstances and has an object to provide a packaging method capable of sealingly containing a high-adhesive material in a simple configuration and of easily separating the material from a bag of a packaging container, and to provide the packaging container.

Means for Solving the Problems (1) To achieve the above objects, the present invention provides a packaging method comprising the steps of: setting a bag in which contents is packed, in an openable outer case provided with an opening flap; turning back part of the bag at fold portions so that the part of the bag having an open end is turned inside out; fixing at least part of the out-turned part as a fixing part to any part other than the bag; bringing inner surfaces of the bag at the fold portions into contact with each other, forming a contact portion, to seal the content; and placing the contact portion of the bag in correspondence with an openable part of the flap of the outer case.

(2) Preferably, the packaging method (1) further comprises the step of fixing at least the part of the out-turned part to the outer case.

(3) In the packaging method (1) or (2), preferably, at least two opposite surfaces of side surfaces of the outer case are formed with cutouts, and the bag is partially inserted in the cutouts to be fixed to the outer case.

(4) In the packaging method (2) or (3), preferably, the fixing part of the bag is placed in a position to pull the out-turned part of the bag when the outer case is opened.

(5) Further, according to another aspect, the present invention provides a packaging container comprising: an openable outer case provided with an opening flap; and a bag with an open end for packaging contents in the outer case; wherein the bag is partially turned back at fold portions so that part of the bag having the open end is turned inside out, at least part of the out-turned part of the bag is fixed as a fixing part to any part other than the bag, and inner surfaces of the bag at the fold portions are placed into contact with each other, forming a contact portion, to seal the content, and the contact portion is placed in correspondence with an openable part of the flap of the outer case.

(6) In the packaging container (5), preferably, at least the part of the out-turned part is fixed to the outer case.

(7) In the packaging container (5) or (6), preferably, the outer case is formed with cutouts in at least two opposite surfaces of side surfaces of the outer case and the bag is partially inserted therein to be fixed to the outer case.

(8) In the packaging container (6) or (7), preferably, the fixing part of the bag is placed in a position to pull the out-turned part of the bag when the outer case is opened.

The operations and advantages of the above mentioned packaging method and packaging container will be explained below.

The contents such as a high-adhesive material is sealingly packed in the bag and contained in the openable outer case such as a cardboard box. At that time, the bag is partially turned back at the fold portions so that the inner surfaces of the bag at the fold portions are placed in contact with each other, forming a contact portion, to sealingly hold the content. The contact portion of the bag is placed in correspondence with the openable part of the flap of the outer case.

Specifically, the inner surfaces of the bag at the fold portions are in contact with each other so that the bag covers over the content. The contact portion is placed in contact relation in such a manner that fold lines of the fold portions abut on each other or slightly overlap one on the other. Accordingly, the contents made from a high-adhesive material can stick to the bag. The bag thus seals the content.

The bag covers over the contents as above and the contact portion through which outside air may enter the bag is sealed by the bag. Thus, the contents can be contained in a sealed state. The contents in this state can be transferred.

Furthermore, the fold portions of the bag are placed in contact with each other to seal the content. When the size of the bag is appropriately selected, the bag can surely sealingly contain the contents even where the contents and the outer case are different in shape and size.

In a place where the contents are to be used, the outer case is supported with the opening flaps downward so that the flaps are not opened and then is conveyed to a material feeding section. There only the outer case is retained and the flaps are made free, allowing the flaps of the outer case to begin to open by the weight of the content. Since the end portions of the bag are fixed to any parts other than the bag, the flaps of the outer case are opened while causing the bag covering the contents to be peeled from the content. When the flaps of the cardboard box are turned to about 90 degrees or more, the bag is peeled from the lower surface of the content. The contents will further fall down.

The end portions of the out-turned parts of the bag are fixed to the parts other than the bag. Accordingly, when the contents further fall down, the bag is left on the side of the outer case. The bag will be peeled from the contents in an opposite direction to the falling direction of the contents at an angle of about 180 degrees (hereinafter, referred to as a "180-degree opposite direction") to the sides of the content. The adhesive contents stick to the bag. However, when the bag is being peeled in the 180-degree opposite direction, a force against the local adhesive force acts on a portion to be peeled, thereby separating the contents and the bag. As a result, the contents will be separated from the bag and fall by its own weight.

In other words, when the outer case is opened downward, a reaction force occurs in a fixed portion of the bag against the weight of the contents and acts as a force to peel the bag from the content. Thus, the contents can be easily taken out.

Since the end portions of the out-turned parts of the bag are fixed to the outer case, any additional means for fixing and holding the bag is not required in facilities. Thus, there is no need for installing extra equipment, resulting in a cost reduction.

The sides of the outer case are formed with cutouts in which the end portions of the bag can be inserted to fix the bag to the outer case. Accordingly, any other methods such as bonding and heat-welding are not required to fix the bag to the outer case.

When the outer case is held with the opening flaps downward, the contents begin to fall by its own weight from the outer case. In this state, the bag comes peeled from the contents in the 180-degree opposite direction, a force to separate the bag from the outer case due to the adhesive force of the contents is decreased. Because of the cutouts formed in two opposite sides of the outer case, such force is further dispersed.

Accordingly, even a simple configuration that the end portions of the bag are inserted in the cutouts formed in the sides of the outer case allows the bag to be removed or fixed to the outer case at low cost.

The part for fixing the bag is provided in a position to pull the end portions of the out-turned parts of the bag when the outer case is opened. Further, the outer case includes the gatefold flaps which can be opened/closed. Accordingly, when the contents contained in the outer case begins to fall by its own weight, for instance, the contents will push and open the flaps or the flaps will open by their own weight, generating a force to pull the bag rightward and leftward. Here, the position to pull the end portions of the out-turned parts of the bag by the flaps may be selected from a position in which the end portions of the bag are directly fixed to the flaps, a position in which the end portions of the bag are fixed to the sides of the outer case, and other positions.

The force to pull the bag rightward and leftward acts on the bag to be peeled from the content, allowing the contents to fall off the bag.

In the above manner, the part for fixing the bag is provided in the position to pull the end portions of the out-turned parts of the bag in opening the outer case, so that the contents packed in the bag of the outer case can be more easily taken out.

BEST MODE FOR CARRYING OUT THE INVENTION

A detailed description of preferred embodiments of a packaging method and a packaging container embodying the present invention will now be given referring to the accompanying drawings.

First Embodiment

Figure 1:
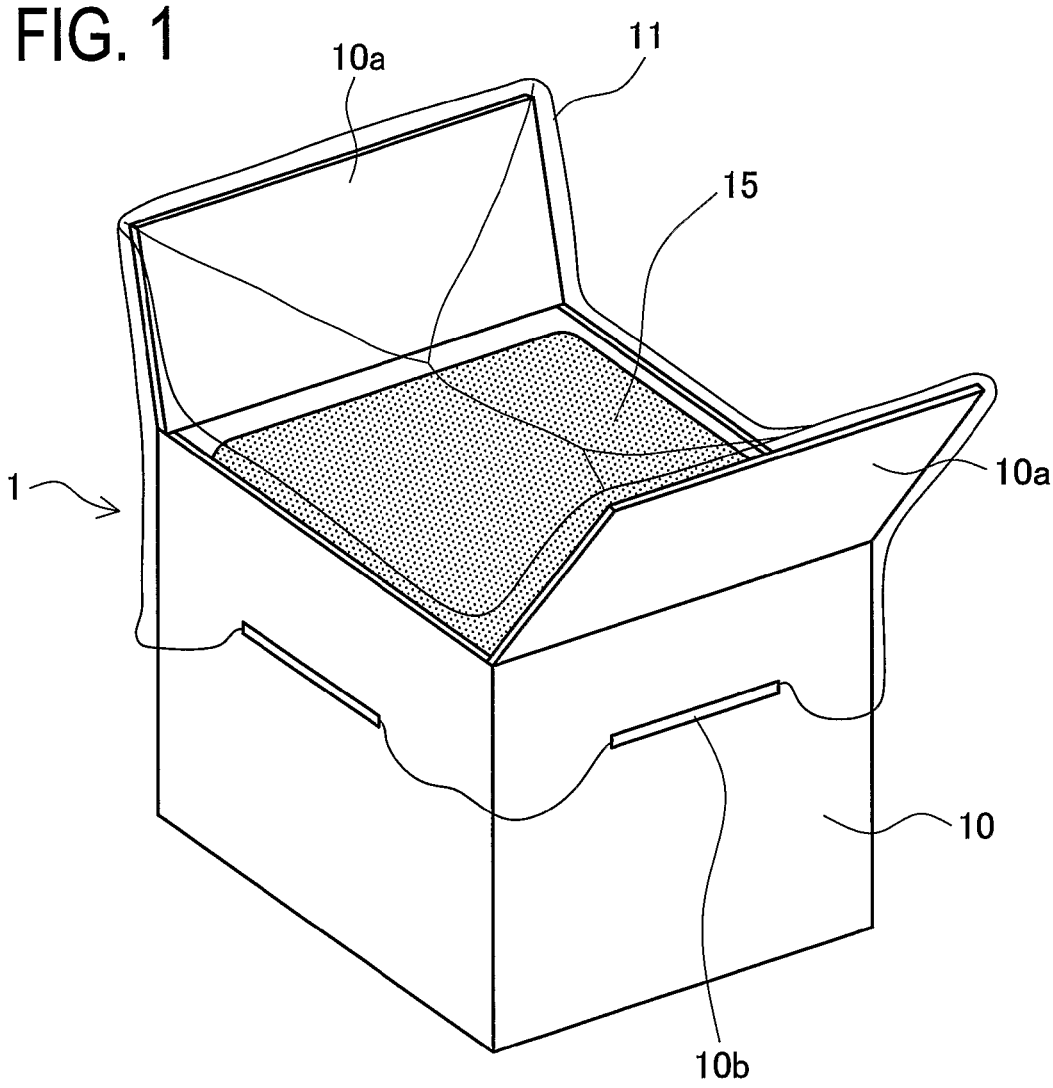
FIG. 1 is a schematic perspective view showing a state where a resin material is contained in an outer case in a first embodiment of the present invention.

Firstly, a first embodiment of the packaging method and the packaging container will be described below. FIG. 1 is a schematic perspective view of a packing container 1 in which a resin material 15 is contained in an outer case 10 in the first embodiment. The packing container 1 includes the outer case 10 and a bag 11.

The outer case 10 is a rectangular parallelepiped case such as a paper cardboard box and a plastic corrugated box. The outer case 10 has double opening flaps 10*a* on one side. The flaps 10*a* can be opened like a gate and closed with their edges abutting on each other to cover the opening of the outer case 10. The outer case 10 is attached with a handle 12 shown in FIG. 2 on a side (an upper side in FIG. 2) opposite to the side on which the closed flaps 10*a* are provided.

In the outer case 10, the bag 11 is set along the inner wall of the outer case 10.

The bag 11 is partially turned back at fold portions 11*d* so that a part of the bag 11 with open end portions 11*a* is turned inside out, and the end portions 11*a* of the bag 11 are inserted and held in slits 10*b* formed as cutouts in the sides of the outer case 10. The bag 11 is retained at only the slits 10*b* of the outer case 10. When the bag 11 is partially turned in this manner, the out-turned part 11*c* of the bag 11 covers the flaps 10*a*.

The slits 10*b* are formed in four sides of the outer case 10 individually. In FIG. 1, each slit 10*b* is a straight slit but may be a V-shaped cutout or other shapes to further prevent the bag 11 from slipping off.

In the bag 11, the resin material 15 is packed as contents. The resin material 15 in this state is an adhesive material such as a material for resin molding of a coil end of a stator of a motor. Accordingly, the resin material 15 packed in the bag 11 sticks to the inside of the bag 11. The bag 11 is a multilayered polyolefin film having a high gas barrier property. Instead of the polyolefin material, any materials capable of preventing styrene gas generated from the resin material 15 from escaping to the outside may be selected.

The resin material 15 packed in the bag 11 is contained in the outer case 10. This outer case 10 is loaded with the opening flaps 10*a* downward and then transferred and stored.

The resin material 15 is packed in the bag 11 and contained in the outer case 10, that is, the resin material 15 is enclosed by the bag 11. Then, the resin material 15 is sealed therein by its own weight and blocked from outside air. It is therefore unnecessary to close the bag 11 and the flaps 10*a* of the outer case 10 with an adhesive tape or the like.

The following explanation will be given to the operations of the packaging method and packaging container in the first embodiment.

Figure 2:
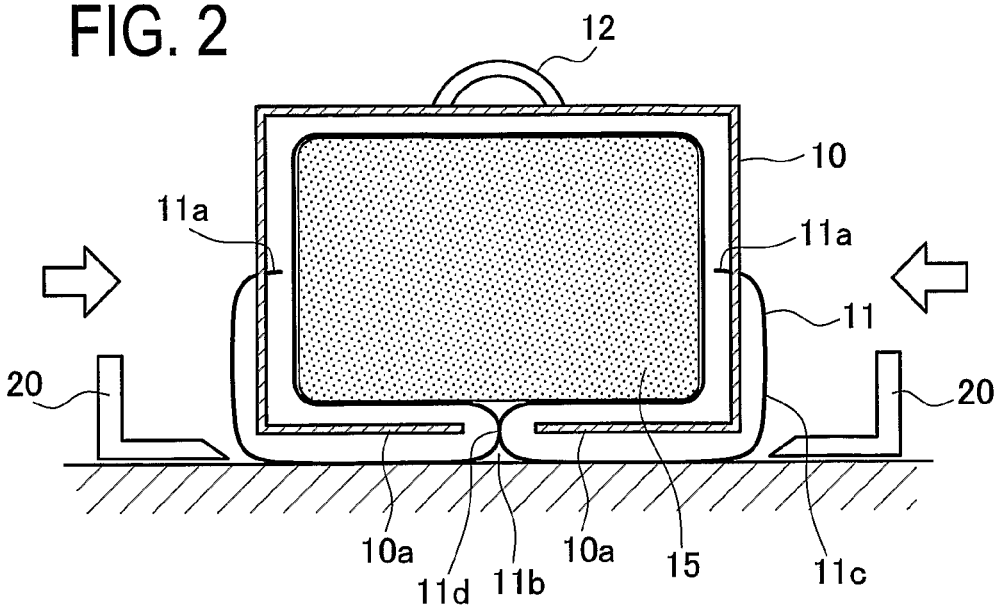
FIG. 2 is a schematic sectional view showing a state where the resin material is contained in the outer case in the first embodiment.

FIG. 2 is a schematic sectional view showing a state where the resin material 15 is packed in the outer case 10. This outer case 10 in which the resin material 15 is contained, with the flaps 10*a* being closed, is carried in a production line. In this state, the flaps 10*a* of the outer case 10 are placed at the bottom as shown in FIG. 2, so that the resin material 15 is pressed against a contact portion 11*b* of the bag 11 by its own weight.

In FIG. 2, the bag 11 is illustrated as if it is spaced from the outer case 10 (the flaps 10*a*) for easy understanding. When the outer case 10 is put with the flaps 10*a* downward, actually, the bag 11 is pressed against the flaps 10*a* by the weight of the resin material 15. The contact portion 11*b* of the bag 11 seals the resin material 15 from the outside by the stickiness of the resin material 15 and its own weight.

The outer case 10 carried in the production line is put so that the flaps 10*a* are at the bottom and the handle 12 is on the top. The outer case 10 is lifted up with the handle 12 grasped by hand or mechanically, arms 20 are inserted under the outer case 10 to support the bottom thereof, preventing the flaps 10*a* from opening, and the outer case 10 is transferred to a predetermined place.

Figure 3:
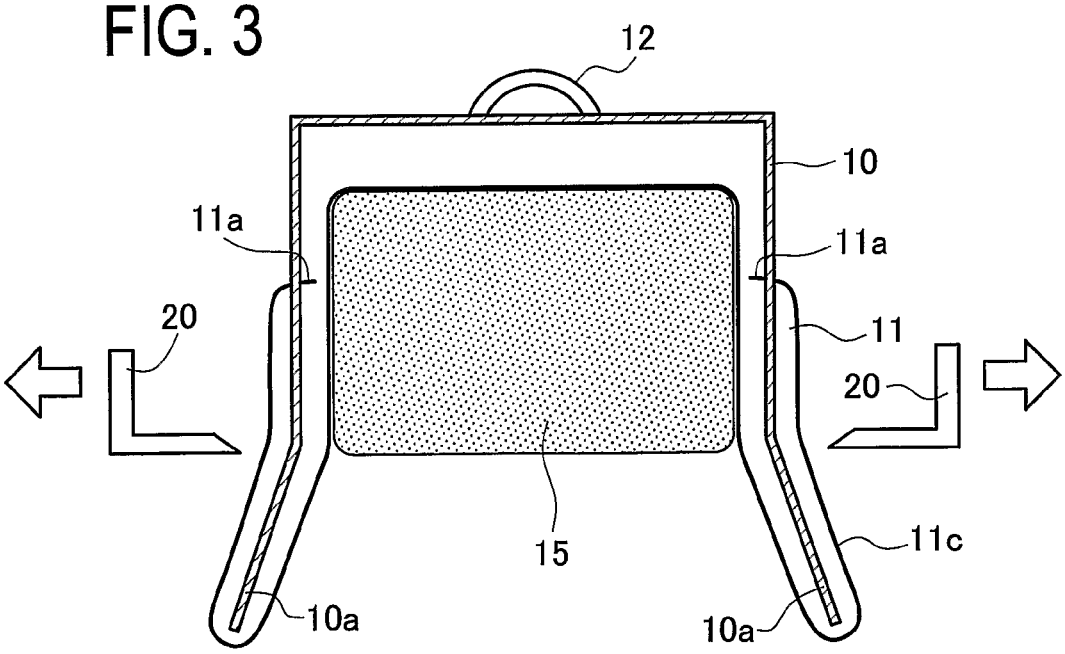
FIG. 3 is a schematic sectional view showing a state where arms supporting lower surfaces of the outer case in the first embodiment are removed rightward and leftward.
Figure 4:
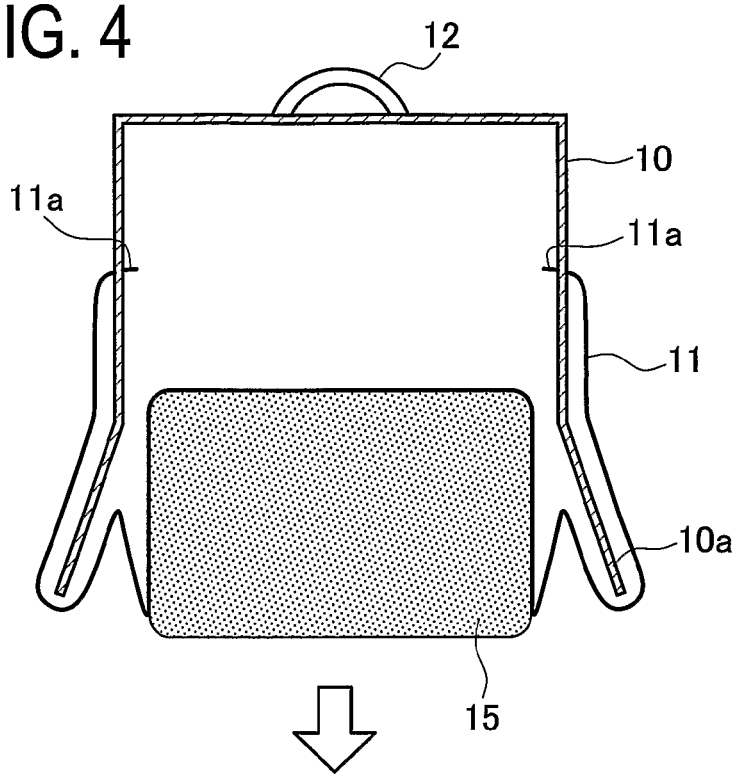
FIG. 4 is a schematic sectional view showing a state where the resin material is falling off the outer case in the first embodiment.
Figure 5:
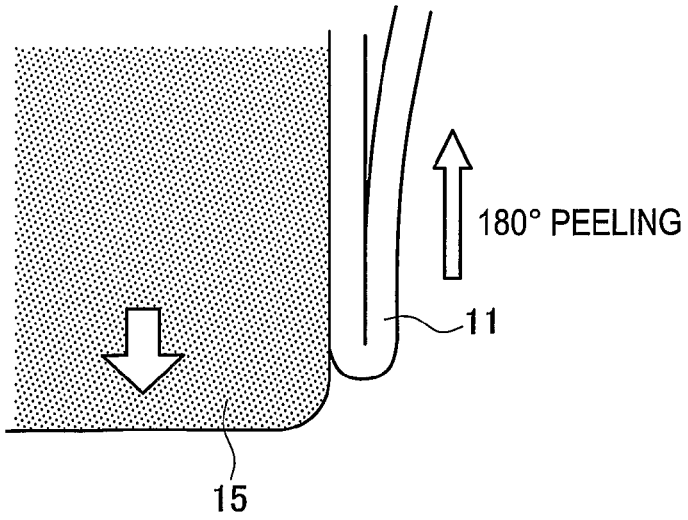
FIG. 5 is a partially enlarged view of FIG. 4, showing how a bag is peeled from the resin material, in the first embodiment.
Figure 6:
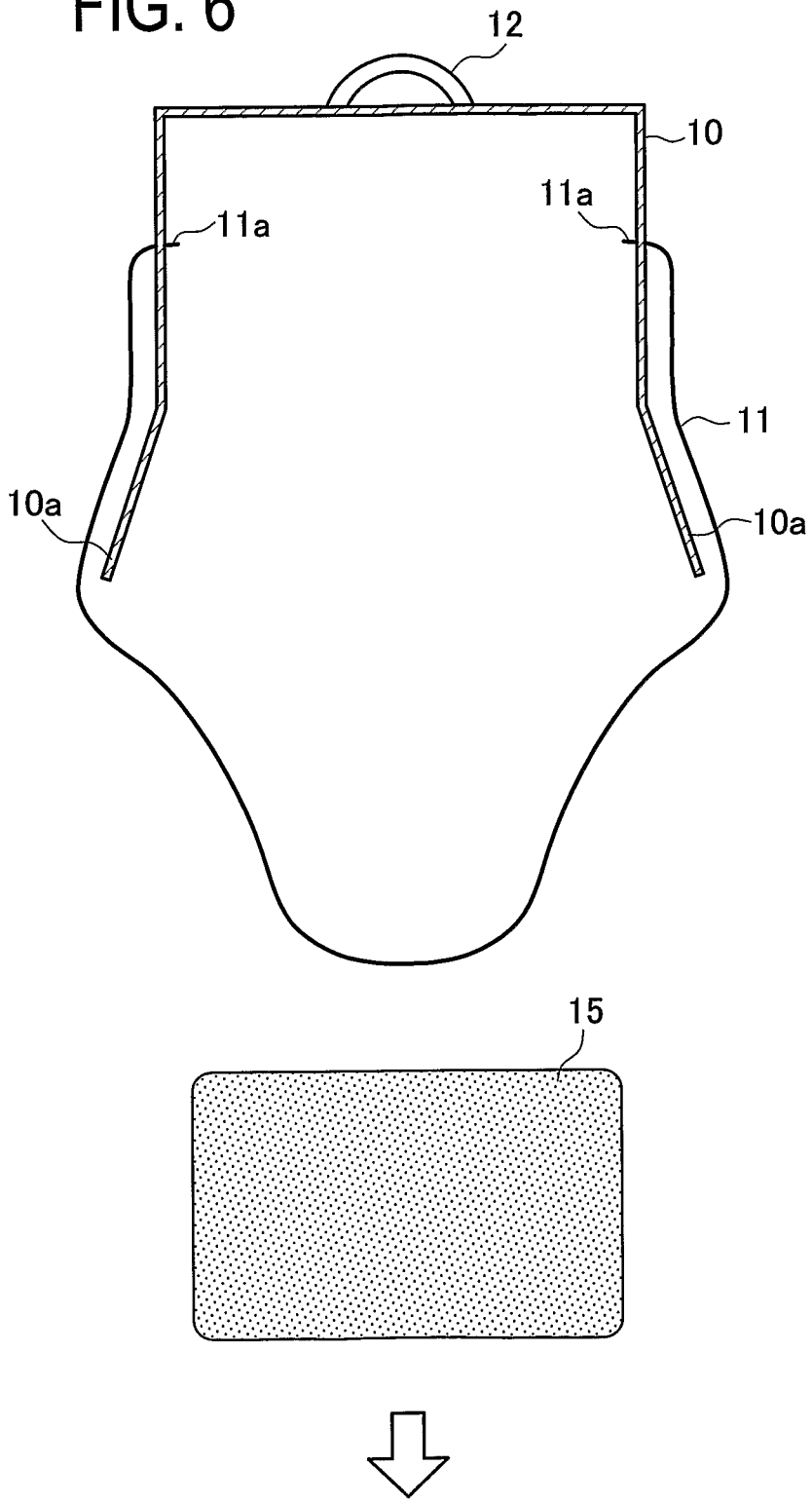
FIG. 6 is a schematic sectional view showing a state where the resin material separated from the bag fully falls off the bag, in the first embodiment.

FIG. 3 is a schematic sectional view showing a state where the arms 20 are removed from the bottom of the outer case 10. FIG. 4 is a schematic sectional view showing a state where the resin material 15 is falling off the outer case 10. FIG. 5 is an enlarged view of a part of the resin material 15 and bag 11 of FIG. 4, showing how the bag 11 is peeled from the resin material 15. FIG. 6 is a schematic sectional view showing a state where the resin material 15 separated from the bag fully falls off the bag 11.

When the outer case 10 is carried above a hopper for feeding the resin material 15 in an injection molding machine, the handle 12 is supported by a carrier device and the arms 20 are removed.

After the arms 20 are removed from the outer case 10, the flaps 10*a* which are not particularly attached with the adhesive tape or the like, are allowed to easily open by the force of the resin material 15 falling down and the self weight of the flaps 10*a* as shown in FIG. 3.

When the flaps 10*a* are opened, the bag 11 covering the flaps 10*a* is caused to open outward by the flaps 10*a*. Thus, the bag 11 begins to be peeled, at the contact portion 11*b*, from the lower surface of the resin material 15. Then, a downward force is given to the resin material 15 by the self weight thereof and therefore a force that pulls the bag 11 rightward and leftward in the figure acts on the contact portion 11*b*. Accordingly, the bag 11 can be peeled from the lower surface of the resin material 15 even if having high stickiness.

When the arms 20 are removed, the resin material 15 is not supported from below and begins to fall together with the bag 11.

The resin material 15 having high stickiness as mentioned above is sticking to the inner surface of the bag 11. Under the downward force of the resin material 15, therefore, the bag 11 which is not supported by the inner surface of the outer case 10 is moved such that the portions covering the lower surface of the resin material 15 are peeled therefrom and the portions sticking to the side surfaces and upper surface of the resin material 15 fall partway together with the resin material 15 while separating from the inner surface of the outer case 10.

The bag 11 is fixedly held by the open end portions 11*a* inserted in the slits 10*b* of the outer case 10. Accordingly, when the resin material 15 falls down partway, the bag 11 with the open end portions 11*a* serving as a fixed end is pulled downward by the resin material 15. At that time, a reaction force is generated in a direction opposite to the falling direction of the resin material 15.

Consequently, the resin material 15 and the bag 11 are gradually separated from each other at 180 degrees as shown in FIG. 5. This separation begins with peeling of the bag from the lower surface of the resin material 15.

Finally, as shown in FIG. 6, the resin material 15 is completely peeled and separated from the bag 11 and thus charged in the hopper not shown located under the resin material 15.

The bag 11 with the end portions 11*a* being inserted in the slits 10*b* of the outer case 10 is held by a frictional force occurring between the end portions 11*a* of the bag 11 and the slits 10*b* of the outer case 10 without slipping off.

The following explanation will be given to the advantages of the packaging method and packaging container of the first embodiment.

A first advantage is that the resin material 15 having relatively high stickiness can be easily separated from the bag 11 set in the outer case 10 in such a simple manner of only lifting up the outer case 10 with the flaps 10*a* downward by use of the handle 12.

Figure 12:
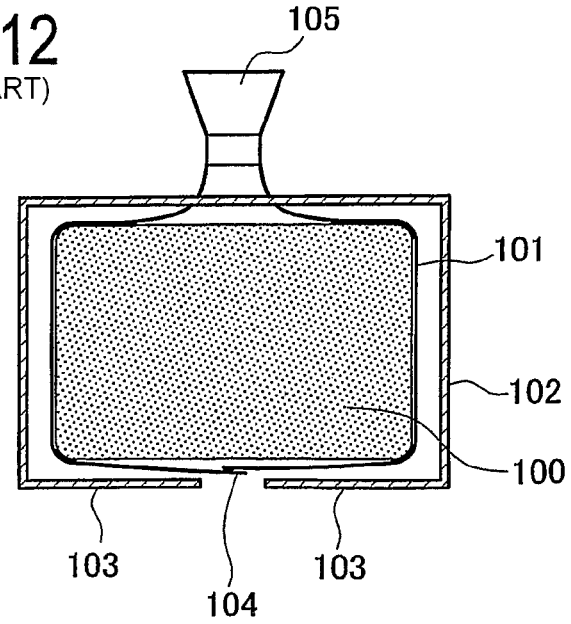
FIG. 12 (PRIOR ART)
FIG. 12 is a schematic sectional view showing a state where a material is contained in a cardboard box in a prior art.
Figure 13:
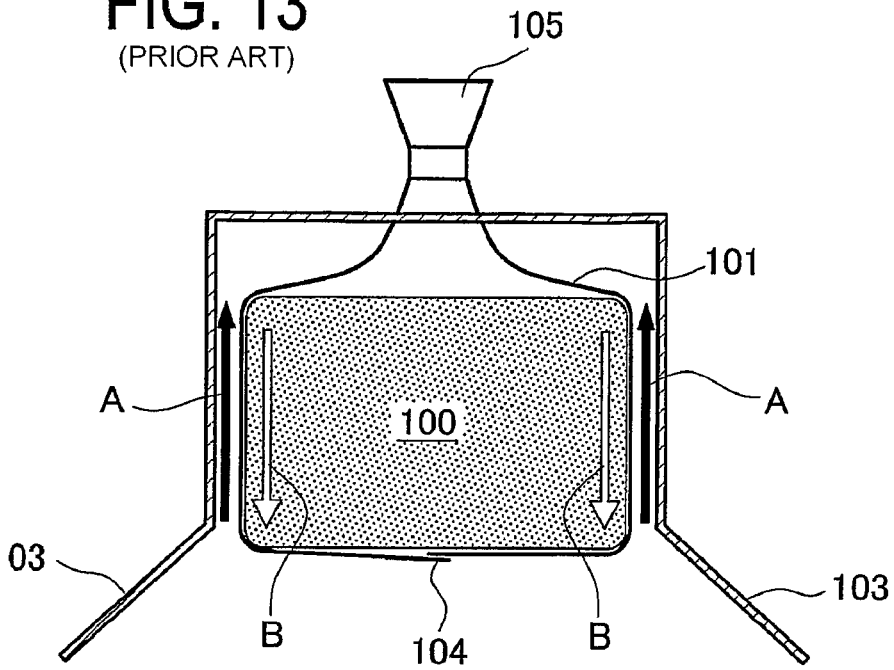
FIG. 13 (PRIOR ART)
FIG. 13 is a schematic sectional view showing a state where a force acts when the material is separated from the cardboard box in the prior art.

In the conventional method shown in FIG. 12, the high adhesive material 100 would not fall depending on a balance between the adhesive force A and the self weight B as shown in FIG. 13. On the other hand, in the present embodiment, the bag 11 is peeled from the resin material 15 in the 180-degree opposite direction as shown in FIG. 5, so that the resin material even if having the stickiness equal to that in the conventional method can be easily separated.

For instance, a simple trial calculation using the model shown in FIG. 12 shows that it is conceivable that a tensile shear force is exerted on the bag because the self weight B acts in parallel with the adhesive force A. Assuming the weight of the resin material 100 is 15 kg, an approximate calculation based on the size of the outer case 102 and a result of sticking evaluation test of the resin material 100 to the bag 101 indicates that about 100 kgf is required to separate the resin material from the bag 101 set in the outer case 102.

The tensile shear force acts on a surface, i.e., the surface of the bag 101 to which the resin material 100 sticks. To separate the resin material 100 from the bag 101, accordingly, a force about seven times the weight of the resin material 100 is required as indicated by the trial calculation. The resin material 100 could not be easily removed by its own weight from the bag 101 set in the outer case 102. This requires a work of scraping the resin material 100 from the outer case 102 by hand or other troublesome works. In short, the work of taking the resin material 100 out of the outer case 102 could not be automated.

In the method of the first embodiment, on the other hand, the peeling in the 180-degree opposite direction can be caused as shown in FIG. 5. The bag 11 is pulled against the resin material 15 because the open end portions 11*a* are fixed to the outer case 10, so that the interfaces of the resin material 15 and the bag 11 are separated from each other from an end (the contact portion 11*b*). In this separating or peeling pattern, a force required to peel acts linearly. Specifically, the peeling occurs on each of the peripheral side surfaces of the resin material 15 contacting with the bag 11, which indicates that a force of about 2 kgf is enough for the peeling.

The resin material 15 is likely to fall by its own weight and can be taken out from the bag 11 set in the outer case 10.

This trial calculation was made without setting detailed conditions such as consideration of a frictional force and therefore may cause deviation from an actually required force. In an experiment by the applicant, however, the resin material 15 could be sufficiently removed by its own weight from the outer case 10. The trial calculation indicates that, for taking out the resin material 15 from the bag 11, the conventional model of FIG. 12 requires a force about fifty times a force required by the model of FIGS. 2 and 5 of the present embodiment.

In the first embodiment, the arms 20 pressing the flaps 10*a* are removed from the outer case 10 with the flaps 10*a* downward, the resin material 15 sticking to the bag 11 is temporarily allowed to freely fall down. From the state of FIG. 2 to the state of FIG. 4, the resin material 15 is allowed to nearly free fall, somewhat boosting the falling speed, even though the resin material 15 is influenced by for example resistance in deformation of the bag 11 and contact resistance against the outer case 10 in which the resin material 15 is contained. Accordingly, by not only the self weight of the resin material 15 but also the inertia force, the resin material 15 begins to separate from the bag 11. Thus, a situation allowing easier separation is produced.

If only the outer case 10 is put with the flaps 10*a* downward, the resin material 15 can be taken out by its own weight from the outer case 10. A work of taking the resin material 15 out of the outer case 10 can be automated.

In the first embodiment, the resin material 15 is used for injection molding to injection mold a coil end of a motor. The weight of the resin material 15 is generally set at about 15 kg in view of circumstances such as transfer. The resin material 15 is also required to be supplied to the hopper of the injection molding machine at relatively frequent intervals.

Such works are heavy labors to workers due to the weight of the resin material 15 and also require personnel costs. To reduce personnel costs and improve labor environment, automation has been demanded. According to the method of the first embodiment, such heavy labors are not required and a cost reduction can be achieved.

A second advantage is that the outer case 10 is formed with two flaps 10*a* and there is no particular need for sealing the flaps 10*a* and the bag 11, so that the resin material 15 can be easily taken out.

Figure 14:
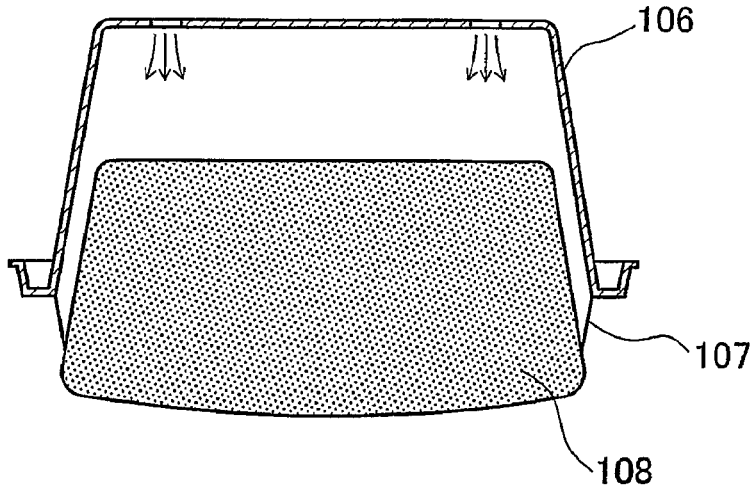
FIG. 14 (PRIOR ART)
FIG. 14 is a schematic sectional view showing a state where margarine is contained in a container body disclosed in JP2002-225937A.
Figure 15:
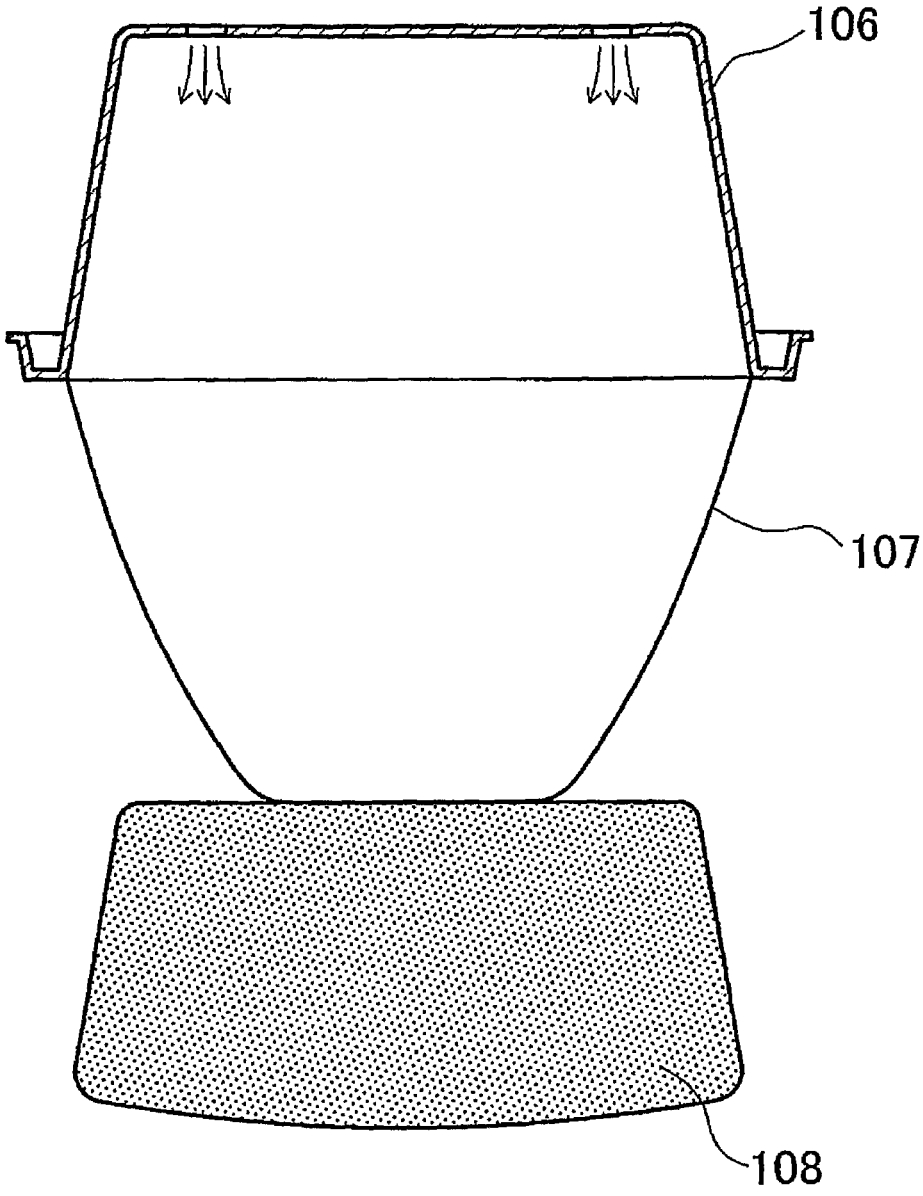
FIG. 15 (PRIOR ART)
FIG. 15 is a schematic sectional view showing a state where the margarine falls off the container body in JP2002-225937A.

The container body 106 shown in FIG. 14 of JP2002-225937A is formed with tapered side surfaces for facilitating separation of the margarine 108. Such configuration requires a lid separate from the bag 107 for ensuring sealing property. Further, there is a case where an aluminum film or the like is adhered to the opening of the container body 106 to enhance the gas barrier property. In this case, the lid and the film have to be removed by hand before taking the margarine 108 out of the container body 106.

On the other hand, according to the method of the first embodiment, the resin material 15 is sealed by its adhesive force in the bag 11, so that the bag 11 and the outer case 10 are not particularly required to be sealed by the adhesive tape or the like. Thus, no additional lid and adhesive tape are needed and no work of removing the lid and adhesive tape is required in opening the outer case 10.

When the outer case 10 with the resin material 15 contained as with the arrival state to a plant is carried into a production line and is held with the flaps 10*a* downward, the resin material 15 can be easily taken out.

In the case where a lid is separately provided or the lid is fixed with an adhesive tape, a work of opening the lid or removing the adhesive tape requires high personnel costs if a worker has to do such work. It is conceivable to open the lid or remove the adhesive tape mechanically, but an introduction cost of an opening device is expensive. According to the present embodiment, on the other hand, the outer case 10 is provided with the opening flaps 10*a* which are closed with no adhesive tape. Thus, the personnel cost and the introduction cost of the opening device are not required, resulting in a cost reduction.

A third advantage is that the open end portions 11*a* of the bag 11 are fixedly inserted in the slits 10*b*, so that no work is required to bond the bag 11 to around the opening of the outer case 10. Since the resin material 15 can be separated from the bag 11 by the 180-degree peeling, only a small force will be exerted on the bag 11. The aforementioned trial calculation estimates the load at about 2 kgf. Since this load is distributed to four side surfaces, each slit 10*b* receives a load of 0.5 kgf. Against such a level of load, it is sufficient to insert the open end portions 11*a* in the slits 10*b* to fix the bag 11 to the outer case 10.

If the bag 11 is bonded to the outer case 10, it is disadvantage at the time of reuse of the outer case 10 and further a work of removing adhesive or the like in recycling the bag 11 is required.

With a configuration that the outer case 10 is formed with the slits 10*b* in which the end portions 11*a* of the bag 11 are inserted, the resin material 15 can be peeled in the 180-degree opposite direction to be separated from the bag 11. Thus, no large force is exerted on the bag 11, no work of bonding is required, and a cost reduction can be achieved, contributing to improvement of recyclability.

Further, the end portions 11*a* of the bag 11 are inserted from outside in the slits 10*b* of the outer case 10. Accordingly, the weight of the flaps 10*a* induces the bag 11 to be peeled from the resin material 15 when the flaps 10*a* are opened. The resin material 15 is allowed to freely fall down by a distance corresponding to the length of each flap 10*a*. When the bag 11 is to be peeled from the resin material 15 in the 180-degree opposite direction, a certain level of inertia force is added, thereby enabling peeling in shorter time.

Since the outer case 10 is configured as above, the side surfaces thereof are not needed to be tapered for facilitating the peeling of the bag 11. The tapered side surfaces may contribute to a reduction in frictional force between the inner surface of the outer case 10 and the outer surface of the bag 11. However, in view of storage space efficiency and producing easiness of the outer case 10, the rectangular parallelepiped shape is advantageous in cost.

As described above in detail, the packaging method and the packaging container of the first embodiment can exhibit the following configuration, operations, and advantages.

(1) Specifically, the packaging container 1 includes the openable outer case 10 and the bag 11 set in the outer case 10 for containing the resin material 15. The bag 11 is partially turned back and at least the open end portions 11*a* of the out-turned part 11*c* are fixed as a fixing part to any part other than the bag 11. The inner surfaces of the fold portions 11*d* of the bag 11 are placed in contact with each other, forming the contact portion 11*b*, to seal the resin material 15. The contact portion 11*b* is placed in correspondence with the side of the outer case 10 having the flaps 10*a*. Accordingly, a packaging method can be provided without needing any work of manually opening the outer case 10 carried in a plant and manually taking the resin material 15 out of the outer case 10.

When the outer case 10 is placed with the flaps 10*a* downward and then the supports are removed from the flaps 10*a*, the resin material 15 will fall by its own weight and thus can be easily taken out. The open end portions 11*a* of the bag 11 are retained by the part other than the bag 11. Therefore, when the resin material 15 is separated from the bag 11 set in the outer case 10, a force is generated in the direction opposite the falling direction of the resin material 15, causing the bag 11 to be peeled from the resin material 15 in the 180-degree opposite direction. This 180-degree peeling makes it possible to take out the resin material 15 by about one-fiftieth of the force needed in the prior art shown in FIG. 12. Accordingly, the resin material 15 can be taken out of the bag 11 set in the outer case 10 by the self weight of the resin material 15.

(2) In the above packaging method (1), the open end portions 11*a* of the out-turned parts 11*c* of the bag 11 are fixed to the outer case 10. When the outer case 10 is placed with the flaps 10*a* downward, the end portions 11*a* of the bag 11 fixed to the outer case 10 generate a force in a direction opposite to the falling direction of the resin material 15 when the resin material 15 begins to fall down. Thus, a packaging method can be provided to cause the 180-degree peeling of the bag 11 from the resin material 15, thereby allowing the resin material 15 to be easily taken out.

(3) In the packaging method (1) or (2), the slits 10*b* are formed in at least two opposite surfaces of the side surfaces of the outer case 10 so that the bag 11 is partially inserted therein to be fixed to the outer case 10. The bag 11 is not required to be fixed to the outer case 10 in any other manners such as bonding and heat-welding.

When the outer case 10 is put with the flaps 10*a* downward, the resin material 15 begins to fall off the outer case 10 by its own weight. At that time, the bag 11 and the resin material 15 are separated in opposite directions 180 degrees. A force of the bag 11 tending to slip off the outer case 10 due to the adhesive force of the resin material 15 is decreased and further dispersed because of the slits 10*b* formed in the two opposite surfaces.

Accordingly, even a simple configuration that the outer case 10 is formed with a cutout or slit in a side surface can prevent the bag 11 from slipping off the outer case 10, thus allowing the bag 11 to be fixed to the outer case 10 in a costless manner.

(4) The packaging container includes the openable outer case 10 and the bag 11 for containing the resin material 15 in the outer case 10. The bag 11 is partially turned back at the fold portions 11*d* so that the end portions 11*a* of the out-turned part 11*c* are fixed as a fixing part to any part other than the bag 11. The inner surface of the fold portions 11*d* of the bag 11 are placed in contact with each other to seal the resin material 15 and the contact portion 11*b* is placed in correspondence with the openable part of the outer case 10, i.e., with the abutting edges of the flaps 10*a*. Accordingly, a packaging container can be provided, with no need to manually open the outer case 10 when carried in a plant and manually take the resin material 15 out of the outer case 10.

(5) In the packaging container (4), the end portions 11*a* of the out-turned part 11*d* of the bag 11 are fixed to the outer case 10. When the outer case 10 is placed with the flaps 10*a* downward, the end portions 11*a* of the bag 11 fixed to the outer case 10 generates a force in a direction opposite to the falling direction of the resin material 15 when the resin material 15 begins to fall down. Thus, a packaging method can be provided to cause the 180-degree peeling of the bag 11 from the resin material 15, thereby allowing the resin material 15 to be easily taken out.

(6) In the packaging container (4) or (5), at least two opposite surfaces of the side surfaces of the outer case 10 are formed with the slits 10*b* in which the bag 11 is partially inserted to be fixed to the outer case 10. Accordingly, the bag 11 can be held in the outer case 10 in a simple manner without slipping off the outer case 10 when the resin material 15 is separated from the bag 11.

Second Embodiment

A second embodiment of the present invention will be described below. The configuration of the second embodiment is substantially identical to that of the first embodiment excepting the positions at which the open end portions 11*a* of the bag 11 are fixed to the outer case 10. The following explanation is therefore made on differences from the first embodiment.

Figure 7:
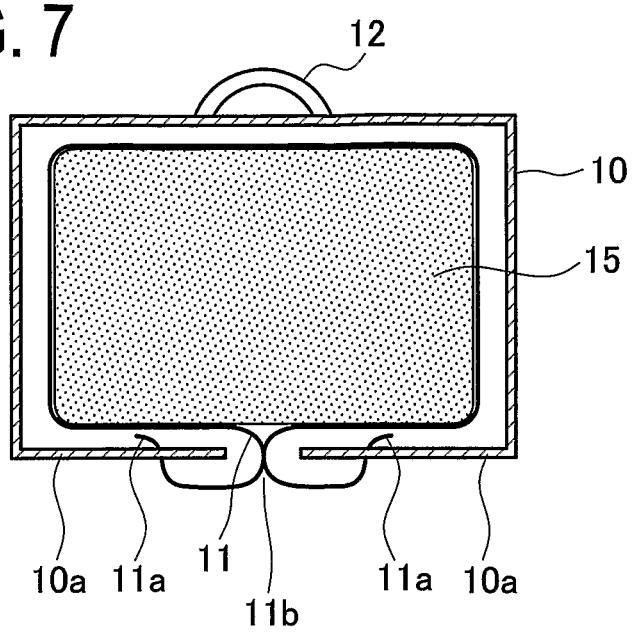
FIG. 7 is a schematic sectional view showing a state where a resin material is contained in an outer case in a second embodiment of the present invention.

FIG. 7 is a sectional view of the outer case 10 of the second embodiment. The open end portions 11*a* of the bag 11 set in the outer case 10 are fixed to the opening flaps 10*a* of the outer case 10. A fixing manner thereof may be achieved for example by inserting the end portions 11*a* of the bag 11 in cutouts formed as in the first embodiment or by using adhesive or a fixing member as needed. The outer case 10 has only two flaps 10*a*. Accordingly, the outer case 10 may supplementarily be formed with the slits 10*b* in the side surfaces to allow the end portions 11*a* to be inserted in the slits 10*b*.

Figure 8:
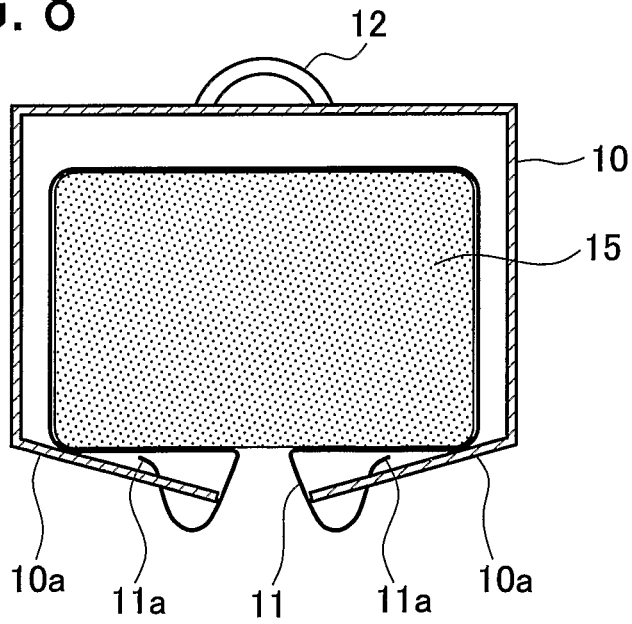
FIG. 8 is a schematic sectional view showing a state where the resin material is contained in the outer case in the second embodiment.

The second embodiment has the above configuration and can exhibit the following operations and advantages. FIG. 8 is a sectional view showing a state where the resin material 15 contained in the outer case 10 begins to fall down.

In the outer case 10 of the second embodiment, as the resin material 15 begins to fall down, the flaps 10*a* are opened by the self weight of the flaps 10*a* and the falling force of the resin material 15 as shown in FIG. 8. When the flaps 10*a* begin to open, the bag 11 is pulled to be peeled from the surface of the resin material 15 because of the end portions 11*a* fixed to the flaps 10*a* of the outer case 10.

Such peeling may be caused by the fixing manner of the first embodiment. However, in the present embodiment in which the open end portions 11*a* are fixed to the flaps 10*a*, the length of the bag 11 can be shortened with reduced allowance, thus more efficiently inducing the peeling of the bag 11 from the resin material 15.

Third Embodiment

A third embodiment of the present invention will be described below. The configuration of the third embodiment is substantially identical to that of the first embodiment excepting the configuration of the outer case 10. The following explanation is therefore made on differences from the first embodiment.

Figure 9:
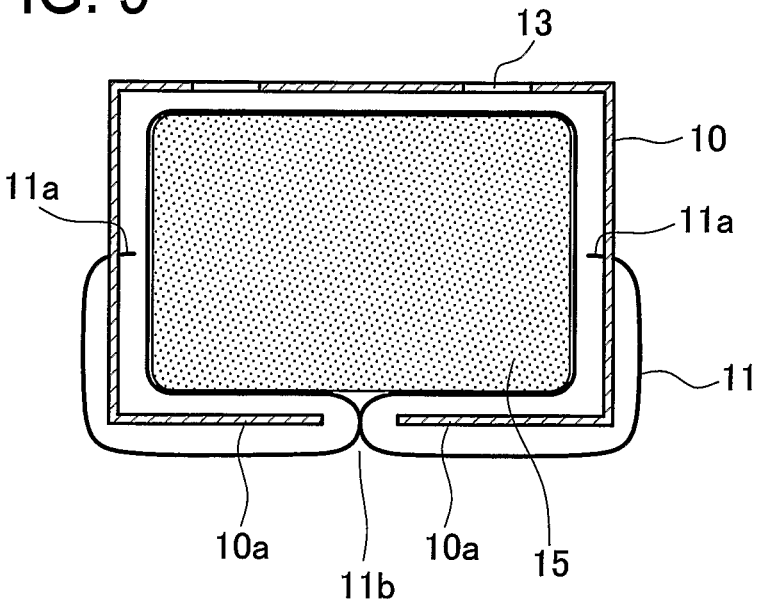
FIG. 9 is a schematic sectional view showing a state where a resin material is contained in an outer case in a third embodiment.
Figure 10:
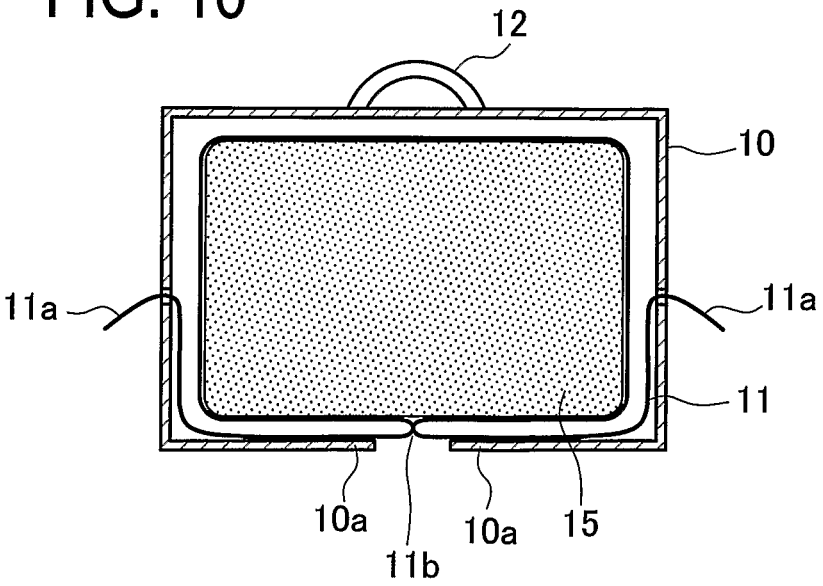
FIG. 10 is a schematic sectional view showing a state where a resin material is contained in an outer case in a fourth embodiment.

FIG. 9 is a sectional view of the outer case 10 of the third embodiment. The outer case 10 includes carrying holes 13 in a surface opposite the surface formed of the closed flaps 10*a*. Each hole 13 can be a simple hole and is formed in the outer case 10, instead of the handle 12 in the first embodiment. The holes 13 may be arranged appropriately at four corners or two diagonally opposing positions in one surface of the outer case 10. The size of each hole 13 may be determined according to the size of a jig for carrying the outer case 10.

The third embodiment has the above configuration and can exhibit the following operations and advantages.

The third embodiment can provide the same advantages as those in the first embodiment even without the handle 12. In the third embodiment, the outer case 10 can be lifted up by inserting a hook in each hole 13. Thus, there is no need for attaching an additional component such as the handle 12 to the outer case 10 and the equivalent advantages can be provided.

If the outer case 10 is provided with a protrusion such as the handle 12, the protrusion may become an obstacle in transfer or storage of the outer case 10 when placed with the surface including the holes 13 downward. In the present embodiment, on the other hand, the holes 13 are directly formed in the outer case 10, so that the holes 13 will not protrude as obstacles.

Fourth Embodiment

A fourth embodiment of the present invention will be described below. The configuration of the fourth embodiment is substantially identical to that of the first embodiment excepting the configuration of the outer case 10. The following explanation is therefore made on differences from the first embodiment.

In the fourth embodiment, different from the first embodiment, the bag 11 is partially turned back and inserted from inside, not from outside, in the slits 10*b* of the outer case 10. After the open end portions 11*a* are fixedly inserted in the slits 10*b*, the flaps 10*a* are closed to seal the resin material 15.

The fourth embodiment has the above configuration and can exhibit the following operations and advantages.

In the fourth embodiment, different from the first embodiment in which the bag 11 is partially inserted in the slits 10*b* from outside, the bag 11 is partially inserted in the slits 10*b* from inside of the outer case 10. Accordingly, only the open end portions 11*a* are exposed outside of the outer case 10 when the flaps 10*a* are closed. Even though the bag 11 is made of a material thinner than the outer case 10, the bag 11 will be less damaged if only small portions of the bag 11 are exposed outside.

In the present embodiment, different from the first embodiment, the bag 11 will not be pulled at the same time when the flaps 10*a* are opened after the outer case 10 is placed with the flaps 10*a* downward and any supports are removed from the flaps 10*a*. Since the open end portions 11*a* are fixed to the outer case 10, the contact portion 11*b* receives the weight of the resin material 15 and thus the bag 11 begins to be peeled from the resin material 15 from the contact portion 11*b* in a 180-degree opposite direction. Consequently, the bag 11 is peeled from the resin material 15, allowing the resin material 15 to fall by its own weight to be taken out of the outer case 10.

Fifth Embodiment

A fifth embodiment of the present invention will be described below. The configuration of the fifth embodiment is substantially identical to that of the first embodiment excepting the configurations of the outer case 10 and the bag 11. The following explanation is therefore made on differences from the first embodiment.

Figure 11:
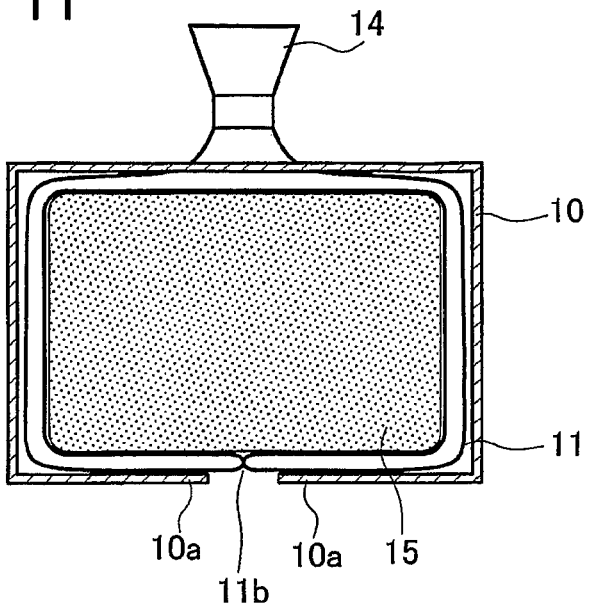
FIG. 11 is a schematic sectional view showing a state where a resin material is contained in an outer case in a fifth embodiment.

FIG. 11 is a sectional view of the outer case of the fifth embodiment. The bag of the fifth embodiment is partially turned back and the open end portion 11*a* is tied to make a knot 14 instead of attaching the handle 12 to the outer case 10. The end portion 11*a* with the knot 14 is drawn out from the surface (an upper surface in FIG. 11) opposite the surface formed of the flaps 10*a* (a lower surface in FIG. 11). Hence, the outer case 10 is previously formed, in the surface opposite the flaps 10*a*, with a hole through which the end portion 11*a* with the knot 14 is drawn out.

In the above configured bag 11, the resin material 15 is packed and sealed by the contact portion 11*b*.

The fifth embodiment having the above configuration can exhibit the following operations and advantages.

In the fifth embodiment, different from the first embodiment, the handle 12 is not provided but the hole is formed in the surface opposite the surface formed of the closed flaps 10*a* so that the end portion Ha of the bag 11 is drawn out of the outer case 10 and tied to make the knot 14. The knot 14 is made larger than the hole of the outer case 10 to fix the bag 11 to the outer case 10.

When the outer case 10 is placed with the flaps 10*a* downward and retained by the knot 14, and then the supports (arms 20) are removed from the flaps 10*a*, a force acts on the bag 11 to move out of the outer case 10 toward the knot 14 side by the falling force of the resin material 15 by its own weight. In the contact portion 11*b*, on the other hand, a force to peel at the 180-degree is generated, allowing the resin material 15 to be taken out of the bag 11.

The bag 11 is not exposed outside excepting the knot 14 and therefore will be less damaged in transfer. Any additional component such as the handle 12 is not required to be attached to the outer case 10, contributing to a cost reduction.

The packaging method and the packaging container of the fifth embodiment can exhibit the above configuration, operations, and advantages.

(1) Specifically, the packaging container 1 includes the openable outer case 10 and the bag 11 set in the outer case 10 for containing the resin material 15. The bag 11 is partially turned back and at least the open end portions 11*a* of the out-turned parts 11*c* are fixed as a fixing part to any part other than the bag 11. The inner surfaces of the fold portions 11*d* of the bag 11 are placed in contact with each other, forming the contact portion 11*b*, to seal the resin material 15. The contact portion 11*b* is placed in correspondence with the side of the outer case 10 having the flaps 10*a*. Accordingly, a packaging method can be provided without needing any work of manually opening the outer case 10 carried in a plant and manually taking the resin material 15 out of the outer case 10.

When the outer case 10 is placed with the flaps 10*a* downward and then the supports are removed from the flaps 10*a*, the resin material 15 will fall by its own weight and thus can be taken out of the outer case 10. The open end portions 11*a* of the bag 11 are retained by any part other than the bag 11. Therefore, when the resin material 15 is separated from the bag 11 set in the outer case 10, a force is generated in the direction opposite the falling direction of the resin material 15, causing the bag 11 to be peeled from the resin material 15 in the 180-degree opposite direction. This 180-degree peeling makes it possible to take out the resin material 15 by about one-fiftieth of the force needed in the prior art shown in FIG. 12. Accordingly, the resin material 15 can be taken out of the bag 11 set in the outer case 10 by the self weight of the resin material 15.

(2) In the packaging method (1), the end portions 11*a* of the out-turned parts 11*c* of the bag 11 are fixed to the outer case 10. Accordingly, when the outer case 10 is placed with the flaps 10*a* downward, the open end portions 11*a* of the bag 11 fixed to the outer case 10 generate a force in a direction opposite to the falling direction of the resin material 15 when the resin material 15 begins to fall down. Thus, a packaging method can be provided to cause the 180-degree peeling of the bag 11 from the resin material 15, thereby allowing the resin material 15 to be easily taken out.

The present invention is not limited to the aforementioned embodiments and may be embodied in other specific forms without departing from the essential characteristics thereof.

For instance, the outer case 10 in the present embodiment is a rectangular parallelepiped case but is not limited thereto. For example, a cylindrical case or container may be adopted if only it has an openable part. However, it is preferable to adopt a nearly rectangular parallelepiped shape which provides a large occupied volume for contents in transfer.

Further, the resin material 15 is exemplified as contents of the present invention but any other materials may be adopted if only having stickiness.

While the presently preferred embodiment of the present invention has been shown and described, it is to be understood that this disclosure is for the purpose of illustration and that various changes and modifications may be made without departing from the scope of the invention as set forth in the appended claims.

The invention claimed is:

1. A packaging method comprising the steps of:

setting a bag in which contents are packed, in an openable outer case provided with an opening flap, wherein the contents are adhesive and a frictional force is created between the contents and the bag;

turning back part of the bag at fold portions so that the part of the bag having an open end is turned inside out around the opening flap, such that the inner surface of the bag at the out-turned portion of the bag faces the environment surrounding the outer case;

fixing at least part of the out-turned part as a fixing part the outer case by inserting the fixing part in at least one cutout in at least one side surface of the outer case;

supporting the outer case with at least one arm;

bringing inner surfaces of the bag at the fold portions into contact with each other, forming a contact portion, wherein the adhesive contents seal themselves against the fold portions of the bag by their own weight when the outer case is supported with the at least one arm; and placing the contact portion of the bag in correspondence with an openable part of the flap of the outer case;

wherein the bag is configured so that the adhesive contents push apart the opening flap of the bag and empty themselves by their own weight once the at least one arm is removed.

2. The packaging method according to claim 1, wherein at least two opposite surfaces of side surfaces of the outer case are formed with cutouts, and the bag is partially inserted in the cutouts to be fixed to the outer case.

3. The packaging method according to claim 1, wherein the fixing part of the bag is placed in a position to pull the out-turned part of the bag when the outer case is opened.

4. The packaging method according to claim 2, wherein the fixing part of the bag is placed in a position to pull the out-turned part of the bag when the outer case is opened.

5. The packaging method according to claim 1, wherein the contents comprise a resin material.

6. The packaging method according to claim 5, wherein the resin material is an adhesive material.

7. The packaging method according to claim 1, wherein the bag comprises a multilayered polyolefin film having a high gas barrier property.

8. The packaging container according to claim 1, wherein the contents comprise a resin material.

9. The packaging container according to claim 8, wherein the resin material is an adhesive material.

10. The packaging container according to claim 1, wherein the bag comprises a multilayered polyolefin film having a high gas barrier property.

* * * * *

UNITED STATES PATENT AND TRADEMARK OFFICE

CERTIFICATE OF CORRECTION

PATENT NO. : 8,622,234 B2
APPLICATION NO. : 12/305185
DATED : January 7, 2014
INVENTOR(S) : Koide et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1246 days.

Signed and Sealed this
Twenty-second Day of September, 2015

Michelle K. Lee

Michelle K. Lee
*Director of the United States Patent and Trademark Office*